United States Patent [19]

Roach et al.

[11] Patent Number: 4,571,920

[45] Date of Patent: Feb. 25, 1986

[54] BEER KEG CAPPING MACHINE

[75] Inventors: Henry P. Roach, Reseda; Jeffrey W. Gunn, Thousand Oaks, both of Calif.

[73] Assignee: APV Burnett & Rolfe, Inc., Chatsworth, Calif.

[21] Appl. No.: 556,156

[22] Filed: Nov. 29, 1983

[51] Int. Cl.[4] ..... B65B 7/28

[52] U.S. Cl. ..... 53/300; 53/309; 53/315; 53/368

[58] Field of Search ..... 53/309, 313, 314, 315, 53/329, 300, 368

[56] References Cited

U.S. PATENT DOCUMENTS

| | | | |
|---|---|---|---|
| 2,665,563 | 1/1954 | Stover | 53/313 X |
| 2,678,763 | 5/1954 | Baer | 53/313 |
| 2,917,880 | 12/1959 | Hohl | 53/314 |
| 3,342,372 | 9/1967 | Whitchurch | 53/313 |
| 3,364,653 | 1/1968 | Wyard | 53/315 |
| 3,550,240 | 12/1970 | Bresley et al. | 53/313 X |
| 3,800,501 | 4/1974 | Raatz et al. | 53/315 |
| 3,874,147 | 4/1975 | Zetterberg | 53/315 |
| 3,967,436 | 7/1976 | Gravesteyn | 53/315 |

*Primary Examiner*—John Sipos
*Assistant Examiner*—Donald R. Studebaker
*Attorney, Agent, or Firm*—Gene W. Arant

[57] ABSTRACT

A keg capping machine primarily for use with beer kegs having protruding neck portions upon which flexible plastic caps are to be fitted. The machine has a capping head attached to the lower end of an inclined cap chute which is attached on its upper end to a cap storing hopper. The capping head has horizontal flanges on its bottom edge which serve as stops and guideways for caps sliding down the chute. The neck of a keg which is carried along a conveyor moves between the guideways and engages the lower portion of a cap forcing it through the capping head. A cap driving rocker within the capping head is employed to force the cap down tightly onto the neck of the keg.

2 Claims, 9 Drawing Figures

BEER KEG CAPPING MACHINE

BACKGROUND OF THE INVENTION

When beer kegs are empty and returned to the brewery they are cleaned and them must be refilled. Small plastic caps are applied to the kegs. The present invention relates to a keg capping machine for automatically capping a sequence of kegs which are on a conveyor.

PRIOR ART

U.S. Pat. Nos. 2,678,763 and 3,550,240 showed the use of a curved spring-loaded cap driver to seat a cap on the neck of a container.

A U.S. patent entitled "Capsulating Machine", U.S. Pat. No. 3,967,436, discloses a keg capping machine which uses a positioning cam to regulate the release of a cap when a feeder chute is raised upon engagement with the neck of a keg.

Other known prior art includes a capping machine manufactured by Draft Systems, Inc. The Draft Systems machine eliminated the positioning cam of U.S. Pat. No. 3,967,436 and substituted horizontal guideways along the bottom of a dispensing head which is raised and lowered upon engagement with the neck of a keg.

SUMMARY OF THE INVENTION

The present invention is directed to a keg capping machine for automatically capping a sequence of kegs, such as those used for beer which are travelling on a conveyor. The invention employs the use of a capping head for dispensing caps onto kegs. The capping head is attached to the bottom end of a chute which on its top end is attached to a hopper for storing caps. The caps slide down the chute to the capping head which has flanged bottom edges which perform both as a stop, and as guideways for the cap.

The kegs to be capped are of a type generally used in the beer industry. Each has a neck portion protruding up from the roof of the keg. The keg also has a circumferential top rim. The keg is aligned on the conveyor, and the conveyor is at such a height that when the keg approaches the capping head the top part of the neck fits between the guideways and also engages the lower end of the cap, pulling the cap through the capping head. A cap driving rocker located within the capping head operates to simultaneously force the cap tightly onto the neck of the keg, while another cap slides into the capping head in the correct position for being applied to the next keg.

It is therefore a primary object of the present invention to provide a keg capping machine which requires very little human attention while the machine operates.

Another object of the present invention is to provide a capping procedure which requires no manual lifting of kegs.

A further object of the present invention is to provide a capping machine which has very few moving parts and therefore costs very little to maintain.

DESCRIPTION OF THE DRAWINGS

The invention will be further described as to an illustrative embodiment in conjunction with the attached drawings in which.

DETAILED DESCRIPTION OF THE PREFERRED EMBODIMENT KEG AND CAP

Figure 1:
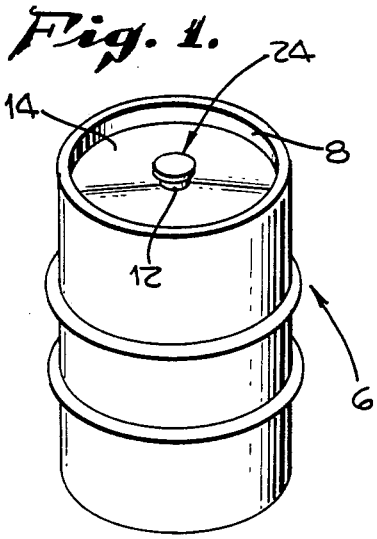
FIG. 1 is a perspective view of a keg.
Figure 2:
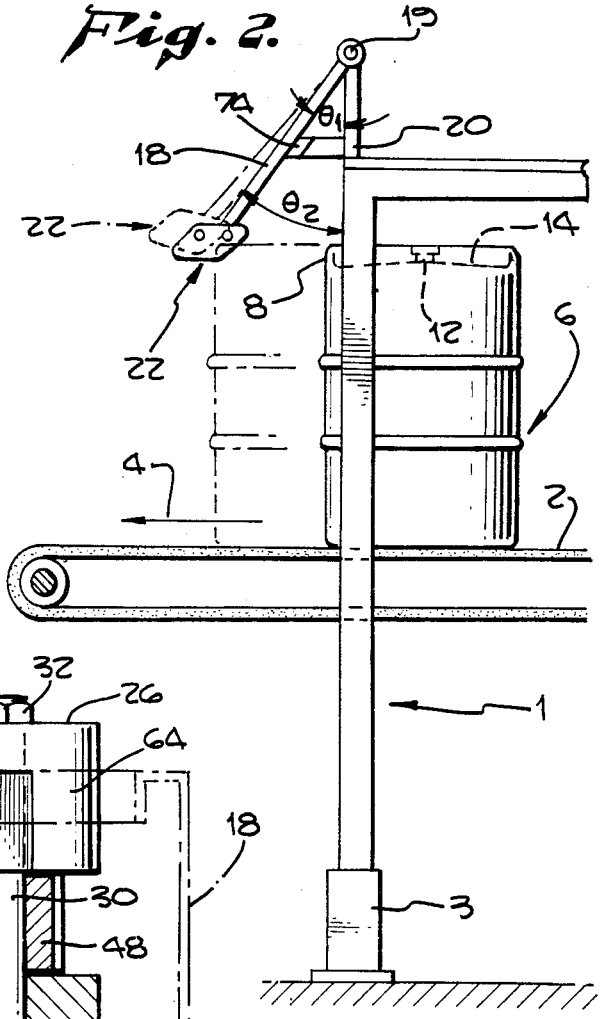
FIG. 2 illustrates the total system setup for the keg capping machine.
Figure 8:
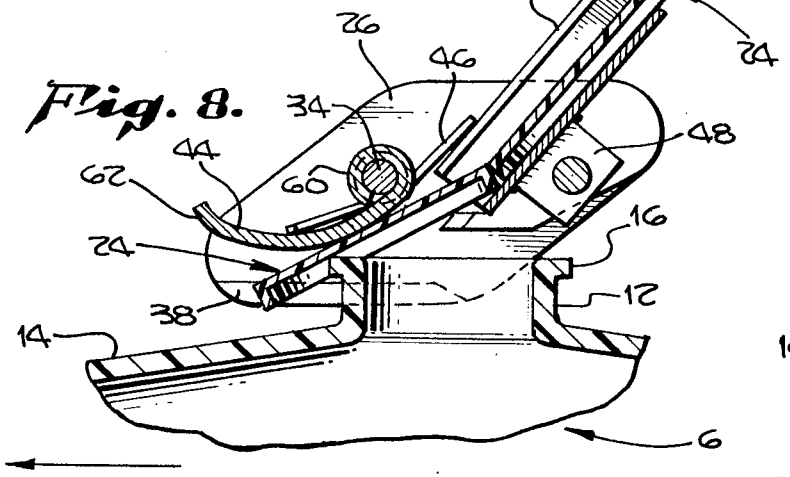
FIG. 8 is a side elevation view of the capping head, partially in cross-section, showing a cap being pushed onto the keg.

Referring to the drawings and to the characters of reference marked thereon, the type of keg 6 contemplated to be capped by this machine is of the type having a rim 8 at its upper edge and a neck 12 centrally disposed on the roof 14 as shown in FIGS. 1 and 2. The neck 12 of the keg 6 has a radially outwardly extending lip 16 as shown in FIG. 8 which a cap 24 will fit over and around. The lip 16 is a circumferential outwardly extending flange.

The plastic cap 24 (see FIGS. 6–9) has an inside diameter equal to that of the lip of the keg. The cap is made flexible so that the cap may be pushed onto the lip, yet sufficiently rigid so that it is held there securely.

SYSTEM ARRANGEMENT

The machine which is the subject of this invention has an upstanding frame structure indicated generally at 1 in FIG. 2.

A conveyor 2 continuously moves in the forward direction of the arrow 4 carrying successive kegs for capping. The base 3 of the frame 1 is adjustable to compensate for varying keg and conveyor heights.

Figure 7:
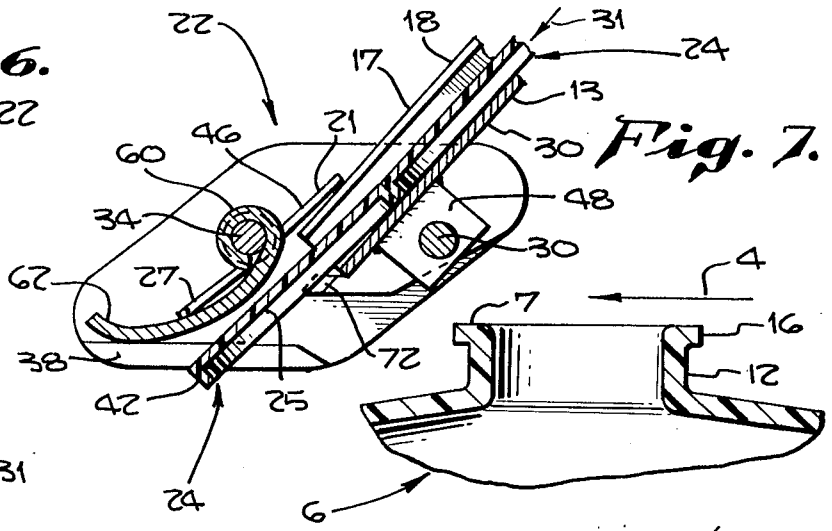
FIG. 7 is a side elevation view of the capping head, partially in cross-section, showing a cap exiting the chute and a keg moving into position to be capped.

On the top of the frame 1 a feeder chute 18 is pivotally mounted above the kegs, and when the capping head is not in contact with a keg the feeder chute is disposed at an angle $\theta_1$ relative to the vertical platform 20 as shown in FIG. 2. The feeder chute 18 is provided to transport successive caps from a hopper (not shown), located near the chute pivot point 19, to a capping head 22 located at a lower elevation. The hopper positions each cap at the upper end of the chute 18 so that it slides down the chute with its capping face 25 oriented downward as shown in FIG. 7.

The chute 18 (see FIG. 4) is composed of a base 13, sidewalls 15, and an inwardly extending flange 17 on the top edge of each sidewall 15. Each flange 17 provides an anchor rest point for a torsion spring 46 on the capping head 22 as more fully described below. While the interior height of chute 18 as shown in the drawings is substantially greater than the height of cap 24, it is preferred to fit the caps more closely in the chute so that each cap is rather precisely directed toward the capping head.

CAPPING HEAD

Figure 3:
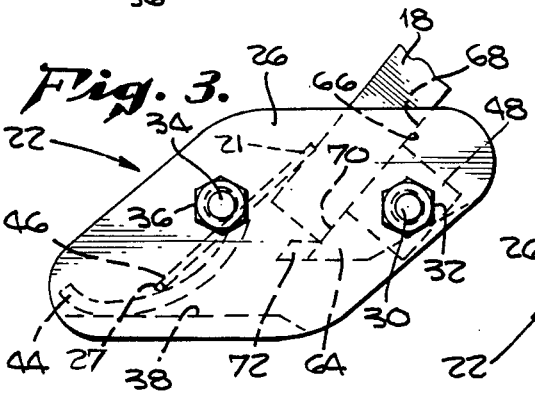
FIG. 3 is a side elevation view of the capping head.

The capping head, indicated generally at 22 in FIGS. 2 through 5 consists, in part, of a pair of spaced parallel vertical sideplates 26 connected near the rear of the capping head by a rear shank 30 and two nuts 32. Here the front is defined as that end of the capping head which the keg encounters first. The parallel sideplates 26 are also connected near the rear of the capping head by a front shank 34 and two nuts 36. The sideplates 26 are comprised of Nylatron or some other resilient material. The use of two shanks prevents rotation of the sideplates 26 relative to each other. (FIG. 3).

The chute 18 is secured to the capping head 22 by means of a steel pillar block 48 soldered to the bottom of the end of the base 13 of the chute as shown at 50 in FIG. 7. The pillar block 48 has a hole drilled through it to receive the rear shank 30, thus securing the entire capping head to the chute.

Figure 9:
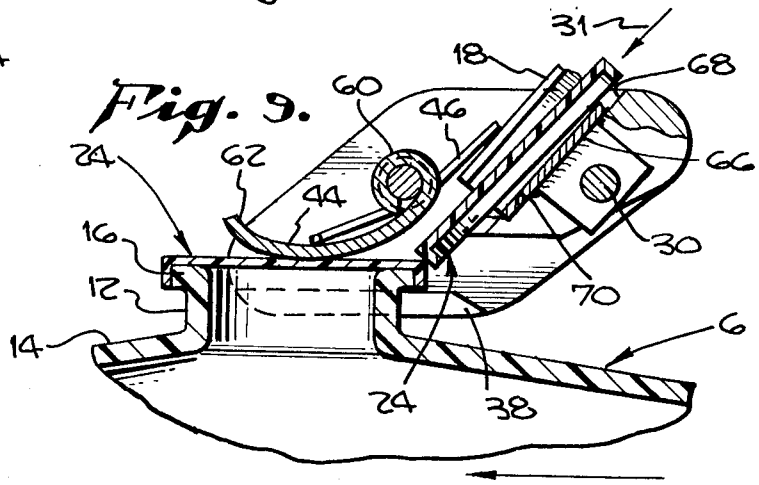
FIG. 9 is a side elevation view of the capping head, partially in cross-section, showing the capping process completed and another cap moving downward from the chute.
Figure 6:
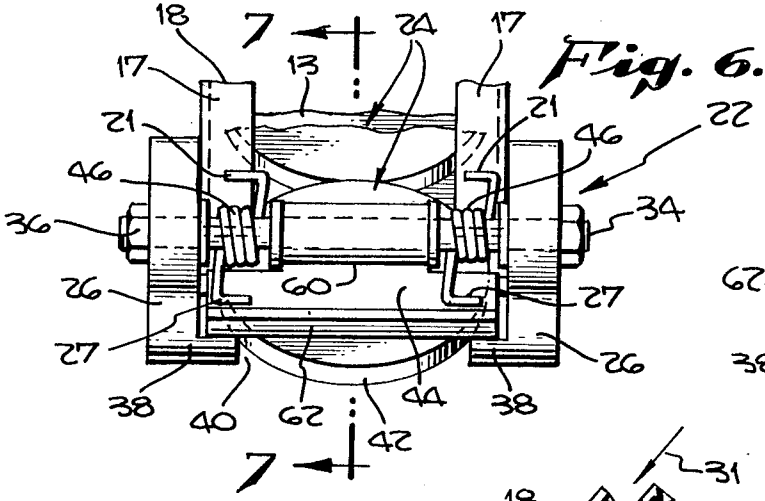
FIG. 6 is a front end elevation view of the capping head of FIG. 3, showing a cap retained in the capping head.

On the bottom of each sideplate 26, an inwardly projecting horizontal guideway 38 is formed. A clearance 40 (see FIGS. 5 and 6) is provided between the guideways 38 so that when a cap 24 slides down from the chute 18 the cap strikes the horizontal guideways 38, which act as a stop; however, the sides of the cap are supported by the guideways while a portion of the cap containing the leading edge 42 is allowed to protrude through the clearance 40 (see FIG. 7). The clearance 40 is sufficient to allow the neck 12 of the keg 6 to pass between the guideways 38 while the lip 16 of the neck passes just above the guideways as shown in FIGS. 8 and 9.

Positioned against the inner surface of each of the sideplates 26 is a torsion spring 46. Each spring is helical and tightly wound along its longitudinal axis so that its ends tend to unwind. Each spring is wrapped around the front shank 34 and oriented so that its rear end 21 pushes against the flange 17 of the chute 18 while its front end 27 pushes down upon the lateral extensions 56 of a capdriving rocker 44 discussed below.

The capdriving rocker 44 is comprised of a metal plate which is curled at its rear end 60 such that the curl fits around the central longitudinal portion of the front shank 34 between the two torsion springs 46. The front end 62 (FIG. 7) of the rocker 44 has a longitudinal convexly curved lower surface which is progressively curved in a direction that approaches the front of the capping head 22. It has two lateral extensions 56 (see FIG. 5) which effectively widen the front end of the rocker. When a keg is not in position to be capped the rocker 44 is held by the rear ends 27 of the torsion springs 46 as shown in FIG. 3, with the rocker extensions 56 resting upon the horizontal guideways 38 of the capping head. When a keg is being capped the cap is slid between the rocker 44 and the lip 16 of the keg and is pushed onto the lip 16 by the curved front end of the rocker as shown in FIGS. 8 and 9 and as discussed below.

Figure 5:
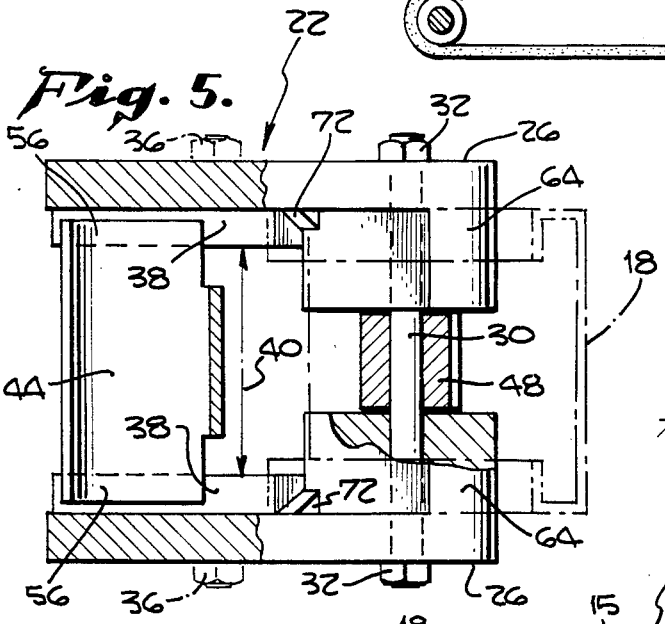
FIG. 5 is a top plan view, partially in cross-section, of the capping head of FIG. 3.
Figure 4:
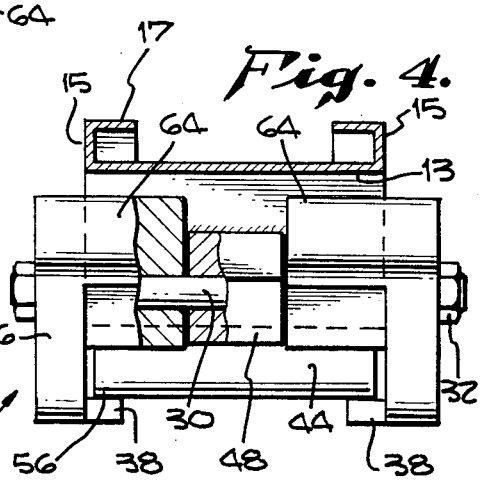
FIG. 4 is a rear end elevation view of the capping head of FIG. 3, with parts cut away to show the internal construction.

Each sideplate 26 of the capping head 22 has an inwardly projecting machined extension 64 which extends to a point adjacent to the pillar block 48 as shown in FIGS. 4 and 5. Since the pillar block 48 is soldered to the chute and centered between the sideplate extensions 64, lateral movement of the capping head relative to the chute is prevented. The sideplate extensions 64 are machined to be limited to a plane extending from the plane formed by the base of the chute 13. Said plane is indicated at 66 in FIG. 3. Therefore, because the base of the chute is adjacent to the sideplate extension 64 at a point above the rear shank 30 (indicated at 68) and a point below the rear shank 30 (indicated at 70), the capping head is unable to rotate in a vertical plane in either direction relative to the chute 22.

At the lowermost part of the sideplate extensions 64, at the end of the chute 18, locating tabs 72 are formed—also as machined extensions of the sideplates. These tabs extend into the pathway of the caps and serve to center the caps laterally and to turn the caps slightly upward as they are departing from the chute, as shown in FIG. 7.

OPERATION

When there is no keg 6 in position to be capped, as noted above, the chute 18 is disposed at an angle $\theta_1$ relative to the platform. The chute is held in place by gravity and by a neoprene stop 74 projected from the platform as shown in FIG. 2. The first point of contact that a keg 6 moving along the conveyor 2 makes with the capping head 22 is at the rim 8 of the keg. The chute changes angle (lifts up) to provide clearance for the rim, as denoted at angle $\theta_2$, then moves back to angle $\theta_1$ after the rim has passed. The chute and capping head stay in the $\theta_1$ position for the remaining capping procedure and are only raised once more—for the opposite side of the rim. During the actual capping, the chute remains in the $\theta_1$ position and the guideways 38 of the capping head remain absolutely horizontal.

Successive caps are lined up in the chute and move forward in the direction of arrow 31 as shown in FIG. 7. When a cap reaches the end of the chute its leading edge 42 is raised slightly by the locating tabs 72. The cap continues to slide out of the chute until it is restrained by the horizontal guideways 38 of the capping head. As shown in FIG. 7, the leading edge 42 of the cap is at a position below the guideways 38. When the keg 6 moves into position to be capped, as shown in FIG. 8, the lip of the keg strikes the cap below the center of the cap and moves along the lower face 25 of the cap, rotating it into a horizontal position, while the cap driving rocker 44, loaded by the torsion springs, squeezes the cap and the lip 16 of the keg between the rocker and the guideways, thereby forcing the cap onto the neck.

In FIG. 9, the cap 24 is firmly in place and another keg is shown moving into position to be capped.

While the invention shown and described herein has been well adapted to fulfill the objects and advantages previously mentioned as desirable, it is to be understood that the invention is not limited to the specific features shown and described but that the means and configuration herein disclosed are susceptible of modification in form, proportion and arrangement of parts without departing from the principle involved or sacrificing any of its advantages and the invention is therefore claimed in embodiments of various forms all coming within the scope of the claims which follow.

We claim:

1. A keg capping machine for automatically capping a sequence of kegs, such as those used for beer, travelling on a generally horizontal conveyor, each keg having an upwardly disposed neck portion with a circumferential flange, the keg capping machine comprising:

a frame;

an inclined feeder chute supported by said frame for transporting caps;

a capping head attached to the lower end of said chute, said capping head having spaced sideplates each having a horizontal bottom flange directed toward the other flange and forming spaced horizontal guideways so that the lowermost cap is fed from the chute between said sideplates and is initially restrained by said guideways with the leading edge of said cap below the guideways, said guideways having open longitudinal ends so that as a keg is moving into position to be capped its neck moves between said sideplates with its flange passing through said opening over said guideways, striking the cap below its center and rotating it toward a horizontal position; and a curved capdriving rocker suspended between said sideplates having spring means which normally urge it into engagement with the guideways so that when a keg is being capped the cap and the circumferential flange of the keg neck are squeezed between said rocker member and said guideways and the cap thus becomes firmly fastened upon the neck of the keg.

2. A machine for automatically capping a filled beer keg having a central neck with a circumferential flange thereon and also having a circumferential top rim, by placing a resilient cap on the neck and flange, said machine comprising:

a frame;

an inclined cap chute having its upper end pivotally supported from said frame;

stop means limiting the downward movement of said chute;

a capping head attached to the lower end of said chute, having a spaced pair of sideplates each having a horizontal bottom flange directed toward the other flange forming spaced horizontal guideways and a curved spring-loaded cap driver which normally rests upon said guideways, said guideways having opening at their longitudinal ends; and said stop means supporting capping head at such elevation that when the keg is moved on a horizontal conveyor underneath the machine, the circumferential flange of the keg neck will pass through said openings and over said guideways and the cap and neck flange will be squeezed between said guideways and said cap driver, thereby securing the cap upon the neck and over the neck flange of the keg;

said chute pivoting upwardly in response to movement of the keg along the conveyor, both before and after the cap is secured to the keg neck, to allow said capping head to pass over the rim of the keg.

* * * * *